US005247144A

United States Patent [19]

Abe

[11] Patent Number: 5,247,144

[45] Date of Patent: Sep. 21, 1993

[54] LEVITATION HEATING METHOD AND LEVITATION HEATING FURNACE

[75] Inventor: Toshio Abe, Kanagawa, Japan

[73] Assignee: Mitsubishi Denki Kabushiki Kaisha, Tokyo, Japan

[21] Appl. No.: 690,629

[22] Filed: Apr. 24, 1991

[30] Foreign Application Priority Data

Apr. 27, 1990 [JP] Japan ..... 2-113175

[51] Int. Cl.[5] ..... H05B 6/32

[52] U.S. Cl. ..... 219/7.5; 219/10.67; 364/400

[58] Field of Search ..... 219/7.5, 10.47, 10.67, 219/10.81, 10.75, 121.36; 361/233; 364/400, 477; 156/DIG. 62

[56] References Cited

U.S. PATENT DOCUMENTS

| | | | |
|---|---|---|---|
| 2,543,053 | 2/1951 | Parker | 219/10.47 |
| 2,943,174 | 6/1960 | Parker | 219/10.47 |
| 2,966,656 | 12/1960 | Bigbie et al. . | |
| 3,584,175 | 6/1971 | Cardot | 219/7.5 |
| 4,188,519 | 2/1980 | Berg | 219/10.47 |
| 4,521,854 | 6/1985 | Rhim et al. | 364/400 |
| 4,565,571 | 1/1986 | Abbaschian | 219/7.5 |
| 4,578,552 | 3/1986 | Mortimer | 219/7.5 |
| 4,896,849 | 1/1990 | Moynihan | 219/7.5 |
| 5,196,999 | 3/1993 | Abe | 219/7.5 |

OTHER PUBLICATIONS

Rhim, "Development of an Electrostatic Positioner for Space Material Processing", Jet Propulsion Lab. CIT, Pasadena, Calif. 91109, Sep. 1984.

*Primary Examiner*—Philip H. Leung
*Attorney, Agent, or Firm*—Wolf, Greenfield & Sacks

[57] ABSTRACT

A plasma lamp placed at the first focal point of an elliptical mirror spherically radiates, the light from the plasma lamp being reflected on said elliptical mirror so as to be spherically condensed to a specimen levitated by an electric field at the second focal point thereof. Thus, the specimen is uniformly heated under the levitated condition.

30 Claims, 10 Drawing Sheets

LEVITATION HEATING METHOD AND LEVITATION HEATING FURNACE

BACKGROUND OF THE INVENTION

1. Field of the Invention

The present invention relates to a levitation heating method and levitation heating furnace to be employed for a microgravity material manufacturing test which is made for manufacturing materials such as a semiconductor material and an alloyed material under the space environment.

2. Description of the Prior Art

FIG. 10 is a block diagram showing an arrangement of a conventional ring-shaped electrode type electrostatic levitation furnace such as is disclosed in U.S. Pat. No. 4,521,854 "CLOSED LOOP ELECTROSTATIC LEVITATION SYSTEM" (Jun. 4, 1985). In the illustration, numeral 1 represents dish-type electrodes concaved downwardly and arranged in confronting relation to each other, 2 designates a specimen placed between the dished electordes 1, 3 depicts a CCD camera for measuring the position of the center of gravity of the specimen, 2, 4 denotes a control circuit coupled to the CCD camera 3, and 5 is a high-voltage power source coupled to the electrodes 1 and the control circuit 4.

The conventional ring-shaped electrode type electrostatic levitation heating furnace has the above-described arrangement and levitates the specimen using electrostatic force. For heating the specimen 2, any heating device is limited because of the effects of non-convection and uniform diffusion under microgravity conditions. For example, electron beam heating causes interference with the electrostatic field. Further, the laser causes concurrent enlargement of the apparatus, and results in heating of only a portion of the surface of the specimen a. Induction heating also causes interference with the electrostatic field and cannot be employed for heating conductive materials. Similarly, a halogen lamp or xenon lamp cannot uniformly heat the specimen 2 and has an extremely short lifetime of about 100 hours. Accordingly, with the above-described problems, all the conventional heating means are unsuitable for the electrostatic levitation furnace. Hence, there is no appropriate heating means which is capable of making a uniform temperature distribution on the surface of the specimen, suppressing Maragoni convection and providing uniform diffusion.

SUMMARY OF THE INVENTION

It is therefore an object of this invention to eliminate the above-described problems.

In addition to the aforementioned object, an object of another embodiment of this invention is to perform a dual elliptical-mirror image heating using two light sources under a high temperature.

According to this invention, a plasma lamp placed at the first focal point of the elliptical mirror spherically radiates, so that the light emitted therefrom is spherically condensed on the specimen placed at the second focal point thereof so as to heat the specimen.

The above and other objects, features, and advantages of the Invention will become more apparent from the following description when taken in conjunction with the accompanying drawings.

DESCRIPTION OF THE PREFERRED EMBODIMENT

Figure 1:
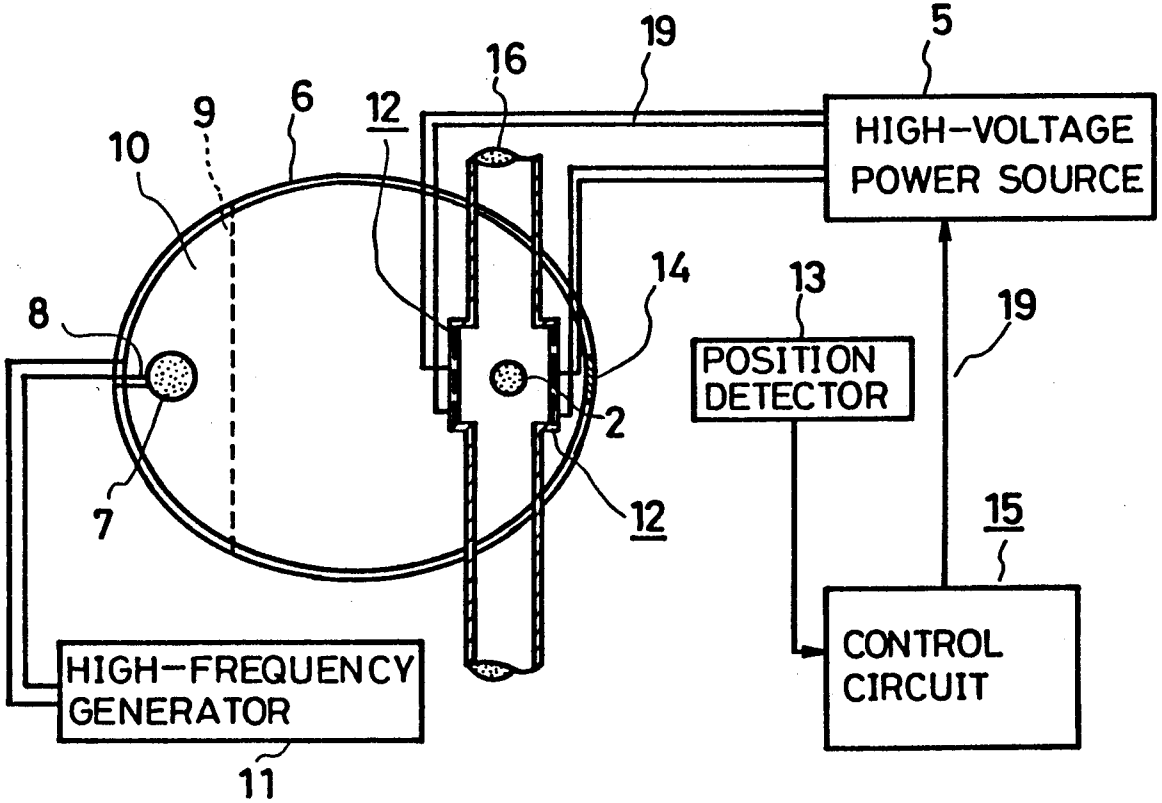
FIG. 1 is an illustration of an arrangement of a ring-shaped electrode type electrostatic levitation furnace according to an embodiment of the present invention.

A levitation heating method and levitation heating furnace according to embodiments of the present invention will be described hereinbelow with reference the drawings. FIG. 1 is a block diagram showing an arrangement of an embodiment of this invention where a specimen and high-voltage power source indicated by numerals 2 and 5 correspond to those in the above-described conventional apparatus.

In the illustration, numeral 6 represents an elliptical mirror which is at its inside equipped with an elliptical reflection surface having first and second focal points, and 7 designates a plasma lamp which is a spherical lamp and which is disposed at the first focal point of the elliptical mirror 6, the plasma lamp 7 being arranged such that a hollow ball is made of a transparent material such as a glass and various elements are enclosed therein. Further, numeral 8 depicts a supporting device for supporting this plasma lamp 7, 9 indicates a disc-like radio-wave shielding plate which is disposed so that its circumferential edge is brought into contact with the inner surface of the first focal point side end portion of the elliptical mirror 6, 10 is a hollow resonator made up with the radio-wave shielding plate 9 and the elliptical mirror 6, and 11 represents a high-frequency transmitter for applying a high-frequency current into the hollow resonator 10 for housing the plasma lamp 7. Still further, numeral 12 designates a pair of ring-shaped electrodes which are respectively attached to a specimen tube 16 to be arranged to be in confronting relation to each other and each of which is formed by two ring-shaped conductive wire gauzes or transparent metals (which is a thin metallic film made by depositing an indium tin oxide (ITO) on a quartz and which has an excellent conductivity), and 13 denotes a position detector for measuring the position of the specimen 2 through an observation window 14 provided in the elliptical mirror 6 so as to be in confronting relation to the specimen 2. For example, the position detector 13 can be arranged by using a CCD camera and silicon plate. In addition, numeral 15 represents a control circuit coupled to both the position detector 13 and high-voltage power source 5.

Figure 2B:
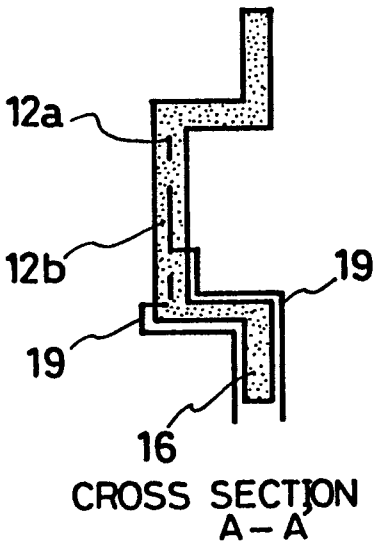
FIGS. 2A and 2B illustrate the relation between a ring-shaped electrode and a specimen.
Figure 2A:
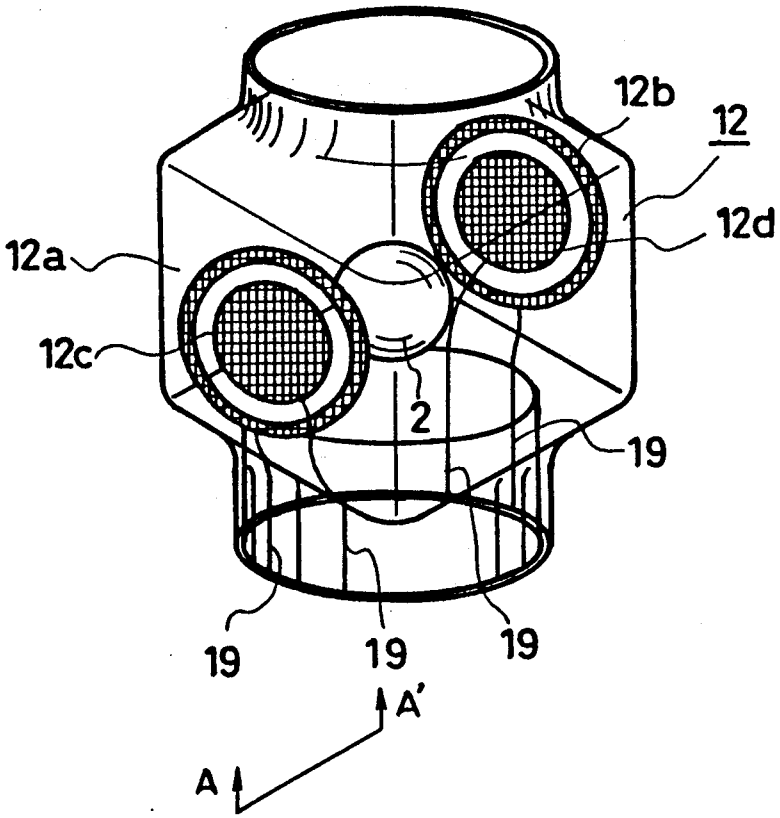

FIG. 2A and 2B illustrate the relation between the ring-like electrodes 12 and the specimen 2, where 12*a* to 12*d* are two pairs of ring-shaped electrodes embedded in the specimen tube 16 so as to be disposed at the central portions of the specimen tube 16 to be in confronting relation to each other with respect to the specimen 2. The specimen 2 is levitated between the two pair of ring-shaped electrodes 12*a* to 12*d* and the specimen tube 16 has a transparent hollow cylindrical configuration and is made of a quartz, a sapphire or the like.

Figure 3:
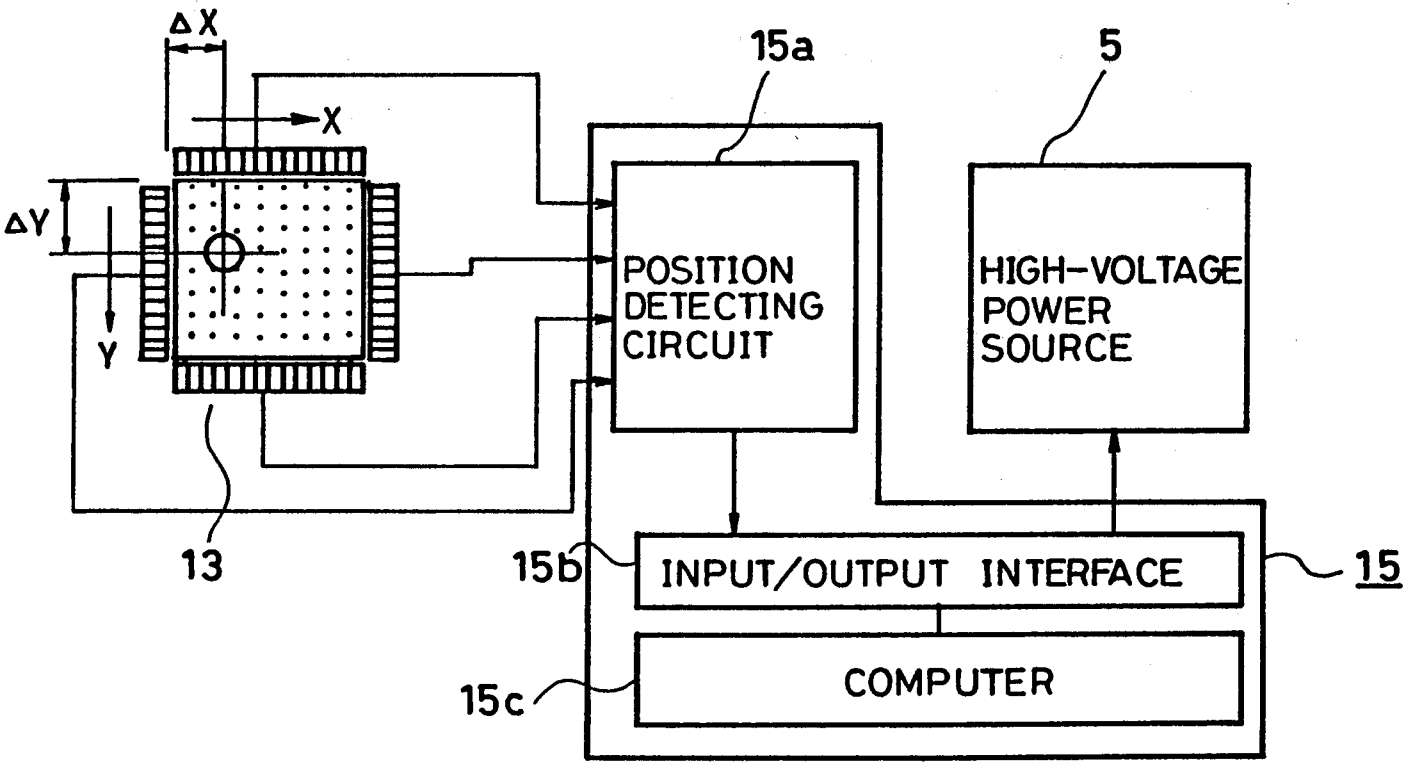
FIG. 3 is a block diagram showing arrangements of a position detector, a control circuit and a high-voltage power source.

FIG. 3 is a block diagram showing arrangements of the position detector 13 and the control circuit 15. The description thereof will be made, for example, in the case of using a PSD (position sensitive detector). From two sides of the plate-like position detector 13 whose dimension is 5 cm square and which has a pn-junction structure formed with a silicon semiconductor, a X- and Y-directional position signal is coupled to a position detecting circuit 15*a*. This position signal is supplied through an input/output interface 15*b*to a computer 15*c*.

Figure 4:
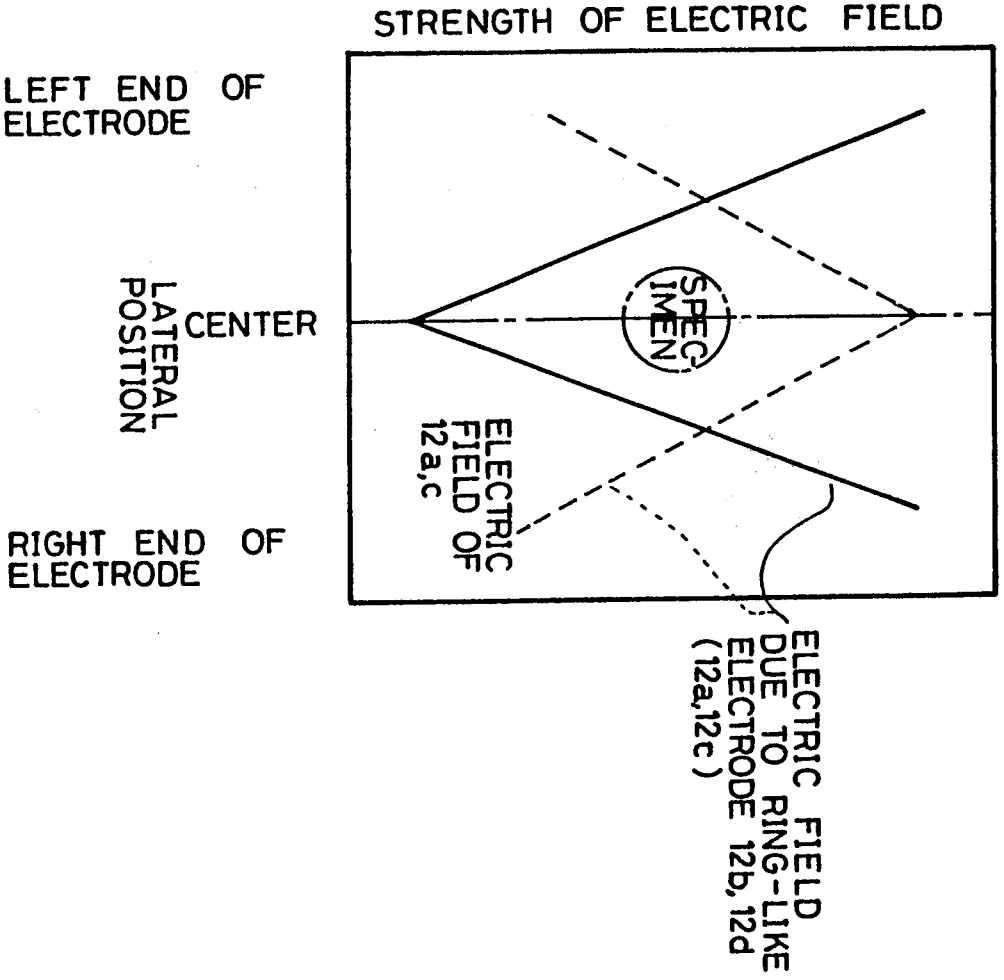
FIG. 4 is an illustration for describing the levitation principle of a specimen.

In the ring-shaped electrode type electrostatic levitation furnace thus arranged, a high voltage from the high-voltage power source 5 is applied to the ring-shaped electrodes 12 so that the specimen 2 is levitated under an electrostatic field. That is, as illustrated in FIG. 4, the transparent ring-shaped electrodes 12 produce a valley-like electric field where the specimen 2 is leviated by means of the Coulomb force, and the position of the specimen 2 is stably controllable by adjusting the strength of the electric field. In response to the levitation of the specimen 2, the position detector 13 detects the position of the specimen 2 and an analog signal corresponding to the detection result is transmitted to the control circuit 15 which in turn, performs the control calculation to obtain a controlled amount to be supplied to the high-voltage power source 5, thereby effecting high-speed position control.

Figure 5:
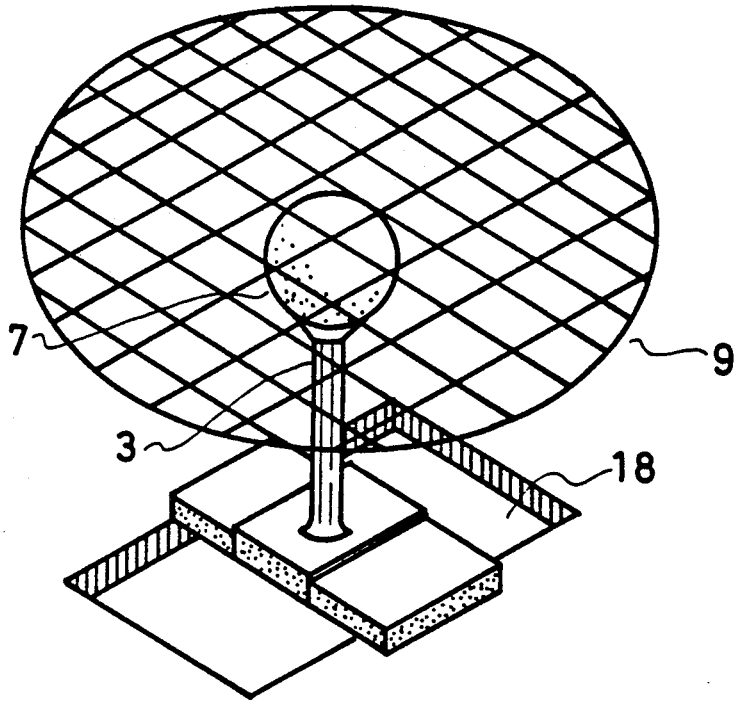
FIG. 5 shows a peripheral arrangement of a plasma lamp.
Figure 6:
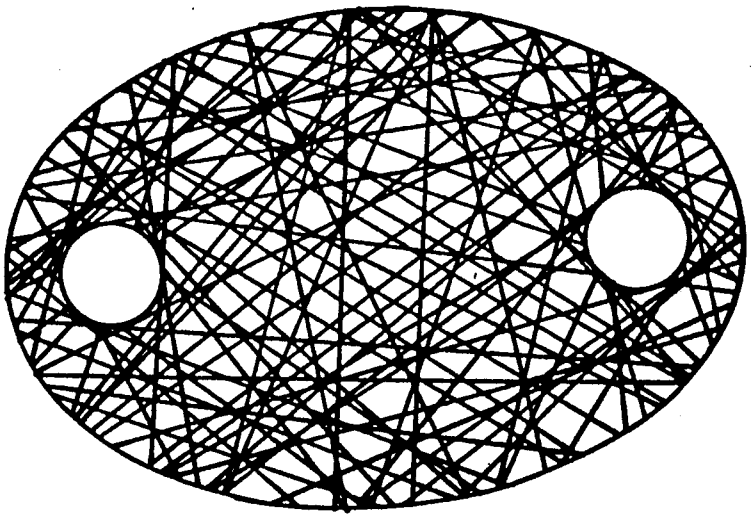
FIG. 6 is an illustration of a simulation of a focusing property due to an elliptical mirror cylinder.

Secondly, in FIG. 5, in response to a radio wave being introduced through a coupling window 18 into the plasma lamp 7, resonance occurs within the hollow resonator 10 so that an electromagnetic energy is applied to a gas within the plasma lamp 7 to thereby energize the plasma lamp 7. Light from the plasma lamp 7, having a spherical configuration, is condensed on the elliptical mirror 6 so as to be spherically focused at the second focal point side. This is as illustrated in FIG. 6. Although FIG. 6 shows a computer-made simulation result in terms of the focusing state, it is seen from FIG. 6 that the light is focused to substantially have a spherical configuration at the second focal point side. The specimen 2 is placed herein to be heated. At this time, the surface of the specimen 2 is uniformly illuminated with the light, and therefore the temperature of the surface thereof can be uniform. In addition, it is possible to heat the specimen 2 with the light having a wavelength corresponding to the optical characteristic of the specimen 2. For instance, melting of a glass for manufacturing a fiber cable, which has been impossible with infrared radiation, can be achieved with ultraviolet radiation. This allows obtaining a pure glass without using a container and further permits manufacturing a super low-loss fiber.

Figure 7:
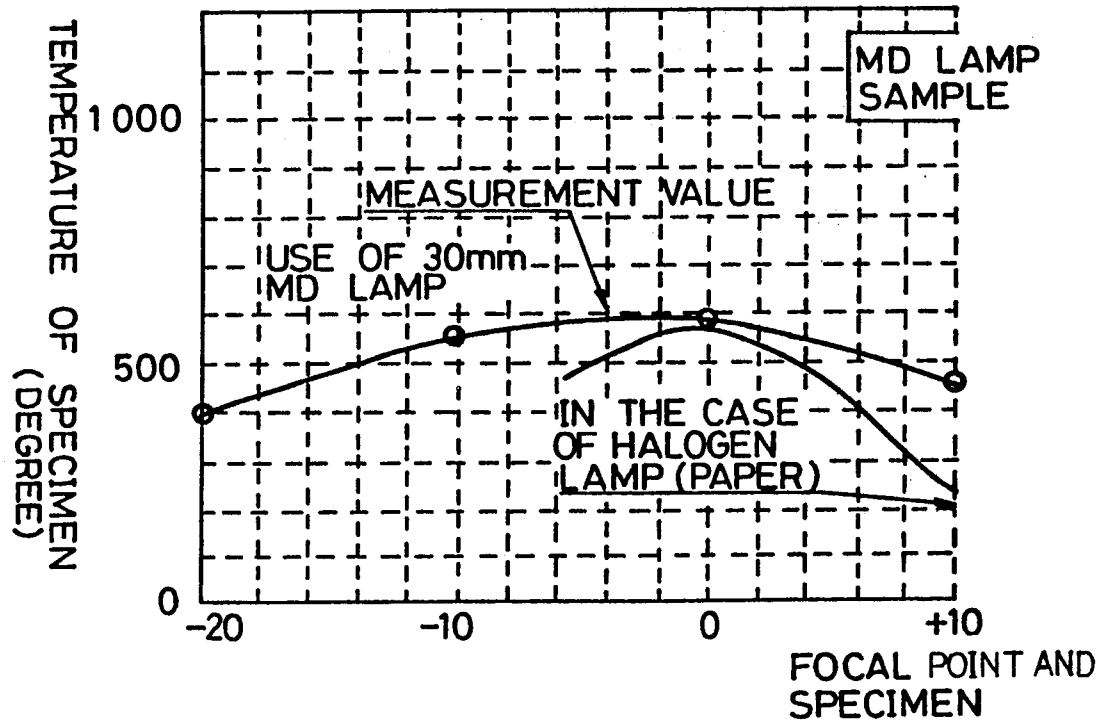
FIG. 7 is an illustration of the measurement data of temperature distribution at the vicinity of a second focal point.
Figure 8:
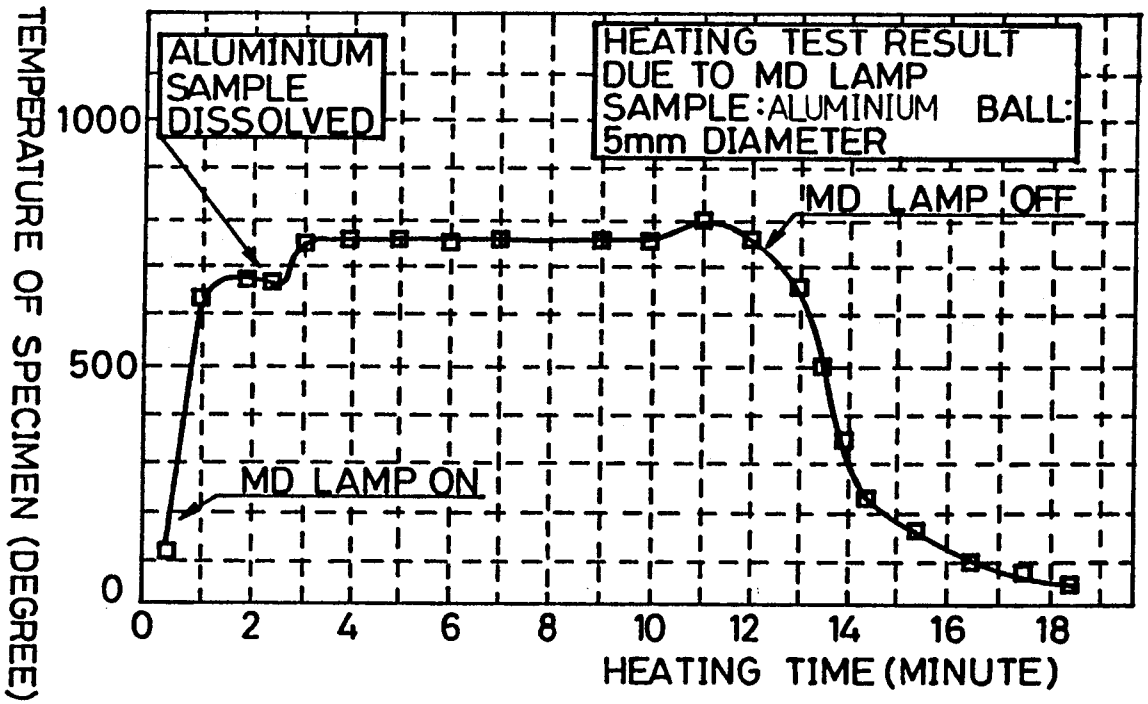
FIG. 8 shows the test data of heating dissolution.

FIG. 7 shows the test data indicating the uniformly heating state. As compared with a conventional halogen lamp, the light distribution at the second focal point is widely spread and the temperature variation is little. FIG. 8 shows the test data indicating the state that a specimen which is an aluminium ball whose diameter is 5 mm is heated to be melted under the conditions that a high-frequency electric power of about 300 W is applied to the plasma lamp and the wavelength of the light is 0.76 microns in the near infrared range. According to this test, it is seen that the specimen can be heated to be melted with a heating efficiency similar to that of the conventional lamp.

Figure 9:
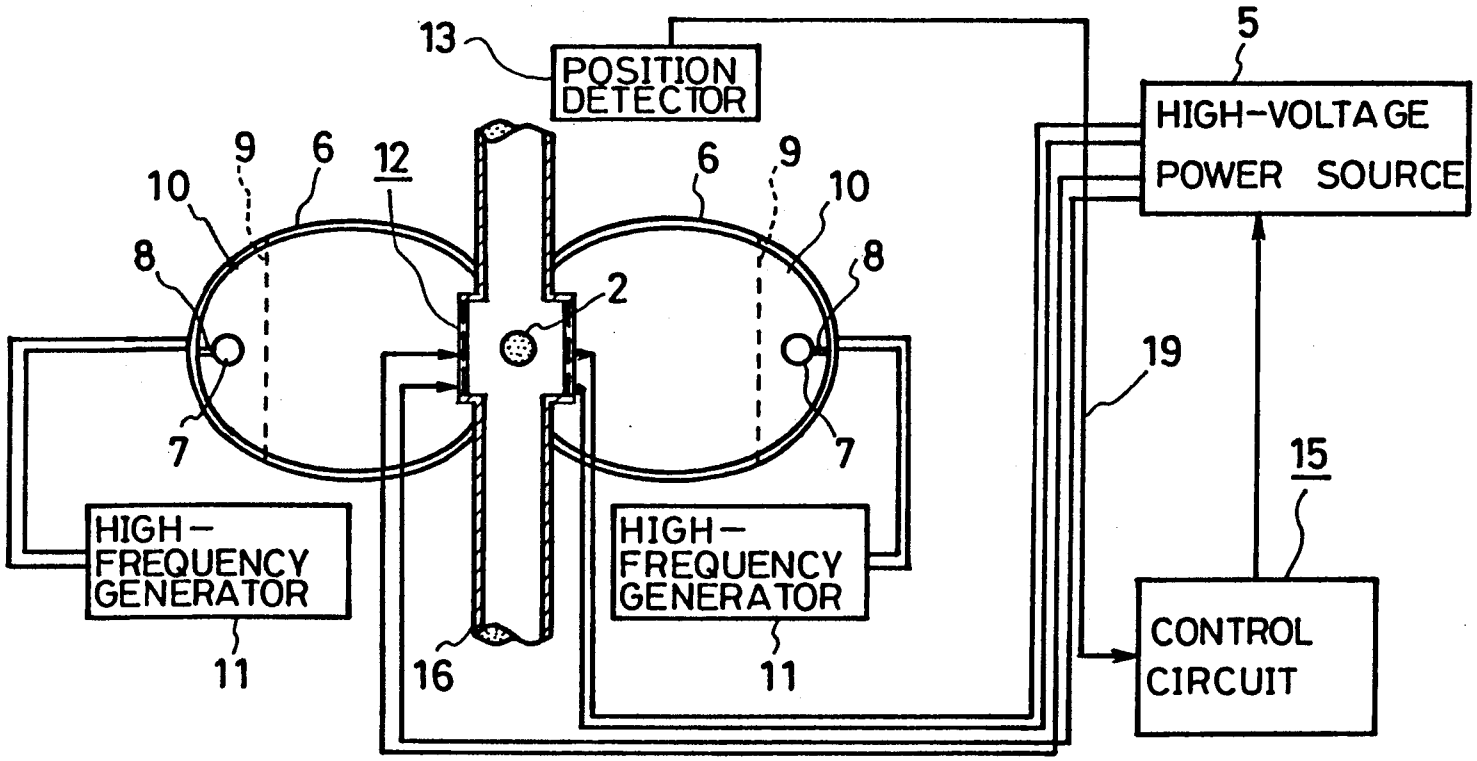
FIG. 9 illustrates an arrangement of a ring-shaped electrode type electrostatic levitation furnace according to an embodiment of this invention.
Figure 10:
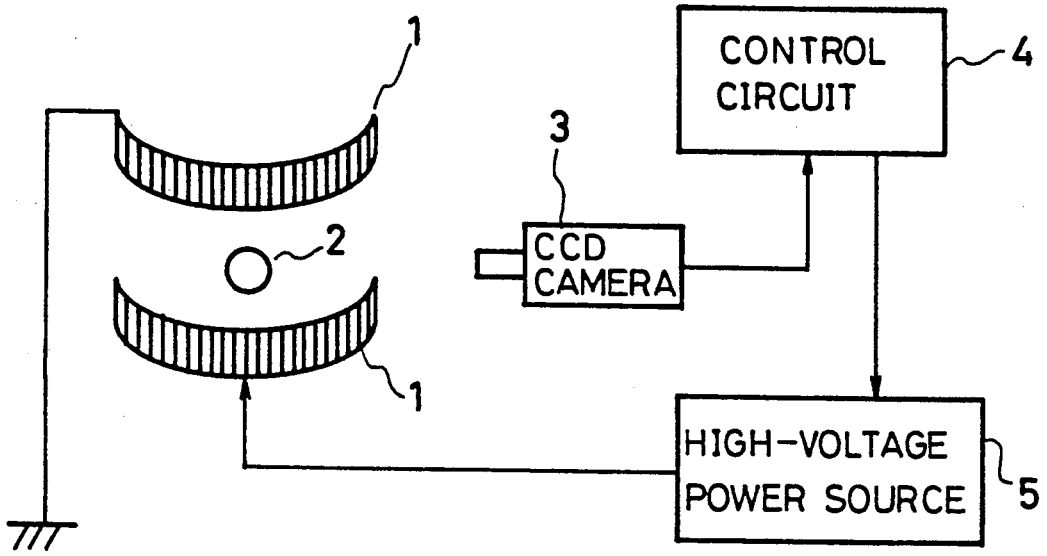
FIG. 10 PRIOR ART
FIG. 10 is a block diagram showing an arrangement of a conventional ring-like electrode type electrostatic levitation furnace.

According to this invention, although as described above a single elliptical mirror 6 is used, it is also appropriate that as illustrated in FIG. 9 a second elliptical mirror 17 is provided such that its second focal point is held in common in the longitudinal directions with respect to the second focal point of the first-mentioned elliptical mirror 6 and in addition a plasma lamp 7, a supporting member 8 and a radio-wave shielding plate 9 are attached to an end portion of the second elliptical mirror 17. The entire surface of the specimen 2 is uniformly and powerfully iluminated with light emitted from both the plasma lamps 7, whereby it is possible to obtain a greater effect because of more uniformly heating it at a higher temperature.

As described above, according to this invention, since the heating of the specimen can uniformly be performed with it being levitated, the possible disturbance can be minimized under the condition of the microgravity, thereby effectively performing the material process. This is very important for the microgravity test. In addition, the heating process can be effected with light such as ultraviolet having a given wavelength, and therefore it is possible to process a material without using a container which has been impossible up to this time, for example, allowing manufacturing a fiber glass, a superconducting material from a fused solution, a foamed alloy, a combined alloy and others. The aforementioned effects have already been confirmed by the test and the analysis.

What is claimed is:

1. A levitation heating method comprising the steps of:

providing an elliptical mirror which has on its inner surface an elliptical reflection surface so as to provide first and second focal points;

placing a spherical lamp at said first focal point so that light emitted from said spherical lamp is condensed at said second focal point, and levitating a specimen at said second focal point by generating an electric field by applying a voltage to electrodes which are arranged to be in confronting relation to each other, whereby the specimen is heated with the light condensed at the second focal point.

2. A levitation heating furnace comprising:

an elliptical mirror which has an inner surface equipped with an elliptical reflection surface having first and second focal points;

a plasma lamp placed at said first focal point of said elliptical mirror;

a radio-wave shielding plate forming, in combination with a portion of the elliptical mirror, a resonator encasing said plasma lamp;

means for receiving a current to be applied to said resonator;

a specimen tube placed at said second focal point of said elliptical mirror;

two pairs of ring-shaped electrodes which are disposed at the vicinity of the center of said specimen tube to be in confronting relation to each other; and means for coupling a signal to said ring-shaped electrodes.

3. A levitation heating furnace as claimed in claim 2, further comprising an observation window provided in said elliptical mirror so as to allow observation of a specimen from the outside, said specimen being positioned at a center portion of said specimen tube.

4. A levitation heating furnace as claimed in claim 3, further comprising a position detector and a control circuit, said position detector being arranged to be in confronting relation with said observation window.

5. The levitation heating furnace of claim 2 wherein each of the ring-shaped electrodes is formed of a conductive wire gauze.

6. The levitation heating furnace of claim 2 wherein each of the ring-shaped electrodes is formed of a transparent metal.

7. The levitation heating furnace of claim 6 wherein the transparent metal is a thin metallic film of indium tin oxide deposited on quartz.

8. The levitation heating furnace of claim 2 wherein the specimen tube has a hollow cylindrical configuration and is made of quartz.

9. The levitation heating furnace of claim 2 wherein the specimen tube has a hollow cylindrical configuration and is made of sapphire.

10. A levitation heating furnace comprising:

a first elliptical mirror which has an inner surface equipped with an elliptical reflection surface having first and second focal points;

a second elliptical mirror having first and second focal points, said second elliptical mirror being arranged so that said second focal point thereof is positioned in common with respect to said second focal point of said first elliptical mirror;

a plasma lamp placed at each of said first focal points of said first and second elliptical mirrors;

a radio-wave shielding plate provided for each elliptical mirror and forming, in combination with each elliptical mirror, resonators respectively encasing each of said plasma lamps;

means for receiving a current to be applied to said resonators;

a specimen tube placed at said second focal points of said first and second elliptical mirrors;

two pairs of ring-shaped electrodes which are disposed at the vicinity of the center of said specimen tube to be in confronting relation to each other; and means for coupling a voltage signal to said ring-shaped electrodes.

11. A levitation heating furnace as claimed in claim 10, further comprising an observation window provided in at least one of said first and second elliptical mirrors so as to allow observation of a specimen from the outside, said specimen being positioned at a center portion of said specimen tube.

12. A levitation heating furnace as claimed in claim 11, further comprising a position detector and a control circuit, said position detector being arranged to be in confronting relation with said observation window.

13. The levitation heating furnace of claim 10 wherein each of the ring-shaped electrodes is formed of a conductive wire gauze.

14. The levitation heating furnace of claim 10 wherein each of the ring-shaped electrodes if formed of a transparent metal.

15. The levitation heating furnace of claim 14 wherein the transparent metal is a thin metallic film of indium tin oxide deposited on quartz.

16. The levitation heating furnace of claim 3 wherein the specimen tube has a hollow cylindrical configuration and is made of quartz.

17. The levitation heating furnace of claim 3 wherein the speciment tube has a hollow cylindrical configuration and is made of sapphire.

18. A levitation heating furnace comprising, an elliptical mirror having an inner elliptical reflection surface defining first and second focal points, a lamp disposed at said first focal point so that light emitted from said lamp is condensed at the second focal point, electrodes arranged to be in confronting relation to each other, means for applying a voltage to the electrodes to generate an electric field to levitate a specimen at the second focal point whereby the specimen is heated with the light condensed at the second focal point.

19. A levitation heating furnace as claimed in claim 18 wherein said lamp is a spherical plasma lamp and further including a radio-wave shielding plate forming, in combination with the elliptical mirror, a resonator encasing said plasma lamp.

20. A levitation heating furnace of claim 18 wherein the light emitted from the lamp has a wavelength corresponding to the optical characteristics of the specimen.

21. The levitation heating furnace of claim 18 further comprising a specimen tube placed at said second focal point of said elliptical mirror.

22. The levitation heating furnace of claim 21 wherein the specimen tube has a hollow cylindrical configuration and is made of quartz.

23. The levitation heating furnace of claim 21 wherein the specimen tube has a hollow cylindrical configuration and is made of sapphire.

24. A method for manufacturing a material in a microgravity environment, comprising the steps of:

providing an elliptical mirror having an elliptical reflection surface so as to provide first and second focal points;

levitating a specimen from which the material is to be made at a position corresponding to said second focal point;

illuminating a spherical lamp disposed at a position corresponding to said first focal point, thereby heating the specimen; and terminating illumination of the spherical lamp at an appropriate time.

25. The method of claim 24 wherein the specimen is glass and the material made is glass fiber, and wherein the step of illuminating involves the step of illuminating an ultraviolet light source.

26. The method of claim 25 for making an alloy.

27. The method of claim 24 for making a superconducting material wherein the step of levitating a specimen includes levitating a fused solution.

28. A method for heating a specimen in a microgravity environment, comprising the steps of:

providing an elliptical mirror having an elliptical reflection surface so as to provide first and second focal points;

levitating the specimen to be heated at a condition corresponding to said second focal point;

illuminating a spherical lamp disposed at a position corresponding to said first focal point, thereby heating the specimen.

29. A levitation heating furnace comprising:

a first elliptical mirror which has an inner surface equipped with an electrical reflection surface having first and second focal points;

a second elliptical mirror having first and second focal points, the second elliptical mirror being arranged so that its second focal point is substantially the same as the second focal point of the first elliptical mirror;

a spherical lamp placed at each of the first focal points of the first and second elliptical mirrors; and a levitator for positioning a specimen at the common second focal points.

30. A levitation heating furnace comprising:

an elliptical mirror having an inner elliptical reflection surface defining first and second focal points;

a lamp disposed at the first focal point so that light emitted from the lamp is condensed at the second focal point;

a levitator for levitating a specimen at the second focal point; and a radio-wave shielding plate forming, in combination with the elliptical mirror, a resonator encasing said lamp.

* * * * *